US007918264B2

(12) United States Patent
Dickinson, III

(10) Patent No.: US 7,918,264 B2
(45) Date of Patent: Apr. 5, 2011

(54) CONSTANT VISCOSITY SPEED REDUCER

(76) Inventor: Reynolds H. Dickinson, III, Sycamore, IL (US)

( * ) Notice: Subject to any disclaimer, the term of this patent is extended or adjusted under 35 U.S.C. 154(b) by 0 days.

(21) Appl. No.: 10/882,692

(22) Filed: Jun. 29, 2004

(65) Prior Publication Data

US 2005/0284589 A1 Dec. 29, 2005

(51) Int. Cl.
*E06B 9/80* (2006.01)

(52) U.S. Cl. ..... 160/296; 160/8

(58) Field of Classification Search ..... 160/296, 160/133, 8; 49/137, 138; 188/268, 381; 192/58.1; 267/134
See application file for complete search history.

(56) References Cited

U.S. PATENT DOCUMENTS

| | | | | | |
|---|---|---|---|---|---|
| 3,476,227 | A * | 11/1969 | Resener | 192/105 A |
| 4,011,929 | A * | 3/1977 | Jeram et al. | 188/268 |
| 4,188,992 | A * | 2/1980 | Segerljung | 160/296 |
| 4,346,749 | A * | 8/1982 | Singletary et al. | 160/301 |
| 4,429,729 | A * | 2/1984 | Winslow | 160/315 |
| 4,513,805 | A * | 4/1985 | Mase | 160/299 |
| 4,535,829 | A * | 8/1985 | Fukuchi | 160/291 |
| 5,421,221 | A * | 6/1995 | Warchocki | 160/310 |
| 5,634,507 | A * | 6/1997 | Kwoka | 160/310 |
| 6,155,328 | A * | 12/2000 | Welfonder | 160/313 |
| 6,200,220 | B1 * | 3/2001 | Drew | 464/30 |
| 6,591,890 | B1 * | 7/2003 | Grubb et al. | 160/296 |

* cited by examiner

*Primary Examiner* — David Purol
(74) *Attorney, Agent, or Firm* — Anne K. Burkhart

(57) ABSTRACT

A speed reducer assembly for rolling screen systems includes a speed reducer chamber. A resistance element is mounted for movement within the speed reducer chamber. A non-viscous resistance material is provided in contact with the resistance element within the speed reducer chamber.

7 Claims, 2 Drawing Sheets

CONSTANT VISCOSITY SPEED REDUCER

FIELD OF THE INVENTION

The invention relates generally to speed reducers. Specifically, the invention relates to speed reducers for rolling screen mechanisms.

BACKGROUND OF THE INVENTION

Rolling screen mechanisms have become increasingly popular in recent years. Rolling screens provide all of the advantages of traditional hinged screen doors, while affording additional benefits of appearance and convenience. Further, rolling screens can be installed in certain applications, such as french doors, where traditional screens cannot be used.

There are several descriptions of conventional rolling screen mechanisms in the patent literature. For example, U.S. Pat. No. 6,666,252 to Welfonder is directed to a winding mechanism for controlling the retraction and deployment of an architectural covering, such as a window blind or shade having a winding element 12, about which the covering, or its lift cord or tapes are wound and unwound with rotation of the winding element about a first axis of rotation, and a fluid brake 40 for retarding the rotation of the winding element in at least one direction about the first axis. The fluid brake comprises a fluid tight compartment 42 containing a liquid and an impeller 46. The compartment and the impeller are adapted for relative rotation about a second axis, which can be the same as or coaxial with the first axis. Either the compartment or the impeller is operatively connected to the winding element. In operation the liquid rotates with the rotation of the compartment or the impeller about the second axis. Rotation of the liquid relative to the impeller or to the compartment in at least a first direction about the second axis is effective to retard the rotation of the winding element in at least a second direction about the first axis. The impeller 46, or a peripheral wall surface 43 of the compartment 42 has a first surface 49B that extends generally radially and substantially parallel with respect to the second axis.

U.S. Pat. No. 6,629,555 to DeBlock discusses a retractable screen door for drawing a flexible screen panel across an opening, including a flexible screen wound around a spring biased take-up shaft, and guide rails for guiding the screen as it is moved across the opening. A unique latch mechanism is disclosed, said latch mechanism being located in the guide rails. Further, the screen may include an adjustable gear assembly for changing the tension on the spring. The retractable screen is optionally designed to have the appearance of a common door casing.

U.S. Pat. No. 6,591,890 to Grubb sets forth a retractable screen mechanism having two tracks mounted on opposing sides of an opening and a screen with a screen material mounted on a frame having two flexible opposing sides corresponding to and adapted to engage the two tracks. A spool mechanism for winding up the screen extends between the flexible opposing sides and engages a third side of the frame and is biased to a wind up position. The spool mechanism has a speed reducer which comprises a resistance structure moving through a viscous fluid to reduce the speed of the biased screen when moving to the wind up position.

U.S. Pat. No. 4,848,522 to Wolf deals with a safety device for preventing accidental unrolling of a rolling shutter or overhead door comprising a cogwheel which has uniformly distributed on the circumference opening outward for containing radially movable tumblers, a cage which surrounds the cogwheel that contains an abutment in the form of a recess for the tumblers which are raised by the action of centrifugal force. Upon reaching a predetermined rotational speed, the tumblers engage an abutment in the cage and the cage acting as a brake is then driven by the cogwheel and slowed down by friction.

U.S. Pat. No. 4,188,992 to Segerljung discusses a braking device for roller blind spring loaded rods compressing a sleeve affixed to the end of the rod carrying therein several radially movable weight segments. The shaft upon which the rod rotates carries at least one non-rotatable braking element. The centrifugal force generated on the weight segments upon a rapid rotation of the rod forces the segments to press against the braking elements slowing the rod down by friction braking. The braking elements can be flange discs mounted on or affixed to the shaft.

Although some rolling screen systems provide retraction mechanisms, only a few provide the safety of speed reduction. Unfortunately, those that do provide speed reduction use oil or other viscous fluids to provide resistance. Such fluids are subject to wide variations in effective viscosity with varying ambient temperatures. As a result, screen retraction can occur too quickly in hot conditions, or barely at all in cold climates. It can be seen from the foregoing that the need exists for a simple, inexpensive speed reducer for rolling screen systems that are relatively impervious to temperature fluctuations, thus overcoming the deficiencies of known arrangements.

SUMMARY OF THE INVENTION

These and other objects are achieved by providing a speed reducer assembly for rolling screen systems including a speed reducer chamber. A resistance element is mounted for movement within the speed reducer chamber. A non-viscous resistance material is provided in contact with the resistance element within the speed reducer chamber.

The features of the invention believed to be patentable are set forth with particularity in the appended claims. The invention itself, however, both as to organization and method of operation, together with further objects and advantages thereof, may best be understood by reference to the following description, taken in conjunction with the following drawings.

DETAILED DESCRIPTION OF THE INVENTION

Figure 1:
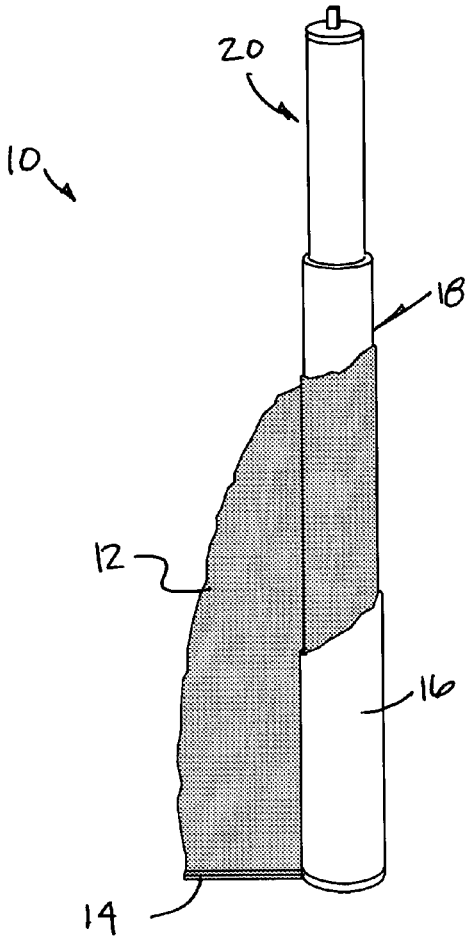
FIG. 1 illustrates a schematic perspective view of a screen retractor with speed reduction embodying the principles of the present invention.

FIG. 1 illustrates a rolling screen system 10 incorporating the principles of the present invention. The rolling screen system 10 includes a screen 12 mounted on a track 14. The screen 12 and track 14 are secured for selective deployment into and out of a housing 16 via a spool mechanism 18, as is known in the art.

Figure 2:
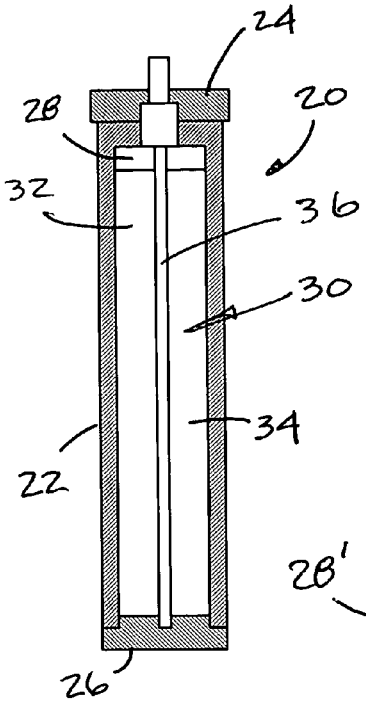
FIG. 2 illustrates a schematic sectional view of a speed reducer assembly embodying the principles of the present invention.

As seen in FIG. 2, a speed reducer assembly 20 is provided to control the opening and closing speeds of the rolling screen system 10. The speed reducer assembly 20 is provided with a generally cylindrical speed reducer housing 22. A cap 24 and a bottom fitting 26 are provided at opposite ends of the housing 22 to define a generally cylindrical speed reducer chamber 28.

A resistance element 30 is mounted for rotation within the speed reducer chamber 28. In the FIG. 2 embodiment, the resistance element 30 includes a pair of opposed paddles 32, 34 mounted on a longitudinal shaft 36. The paddles 32, 34 are substantially planar, and radially outwardly from the shaft 36 to the inner surface 38 of the chamber 28. The resistance element 30 is surrounded by non-viscous resistance material (shown in FIGS. 4-7), which provides constant-speed operation for the system 10.

Figure 3:
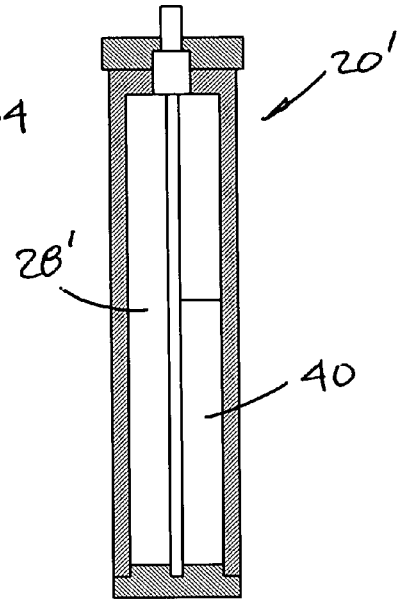
FIG. 3 illustrates a schematic sectional view of another embodiment of a speed reducer assembly embodying the principles of the present invention.

The paddles 32, 34 can be fabricated from any suitable material, for example, from a rigid, durable thermoplastic material. It is contemplated that high-impact plastic, such as PET, would provide particular advantage. The precise material, size, and placement of the paddle or paddles will depend upon several factors, including the nature of the resistance material and the amount of speed reduction desired. For example, an alternative embodiment is shown in FIG. 3, in which the resistance element includes a single paddle 40 extending only half of the height of the speed reducer chamber 28'.

Figure 4:
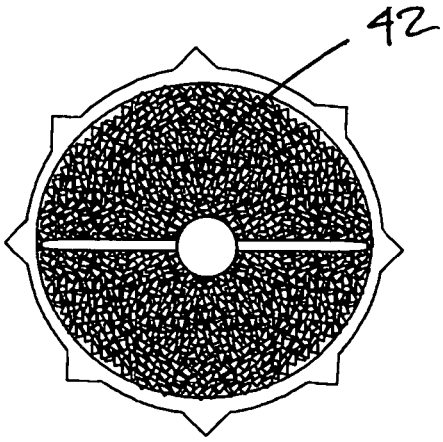
FIG. 4 illustrates a schematic sectional view of an embodiment of another speed reducer assembly embodying the principles of the present invention.
Figure 5:
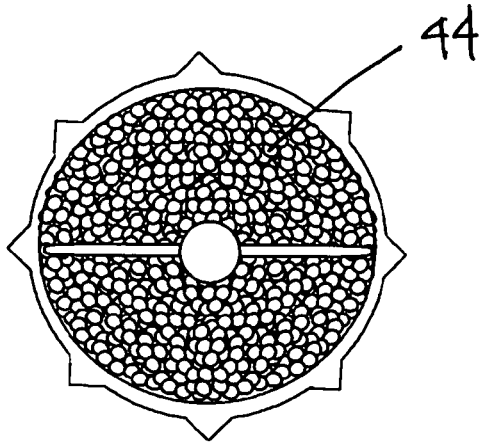
FIG. 5 illustrates a schematic sectional view of another embodiment of another speed reducer assembly embodying the principles of the present invention.

As seen in FIGS. 4-7, a non-viscous resistance material 42 is provided in contact with the resistance element within the speed reducer chamber. The non-viscous material 42 is advantageously provided as a flowable solid, which can be fabricated in a variety of forms. In FIG. 4, the resistance material 42 is provided in the form of irregularly-shaped thermoplastic chips, such as vinyl chips. In FIG. 5, the resistance material 44 is provided as a plurality of generally spheroidal particles, such as ball bearings or plastic pellets.

Figure 6:
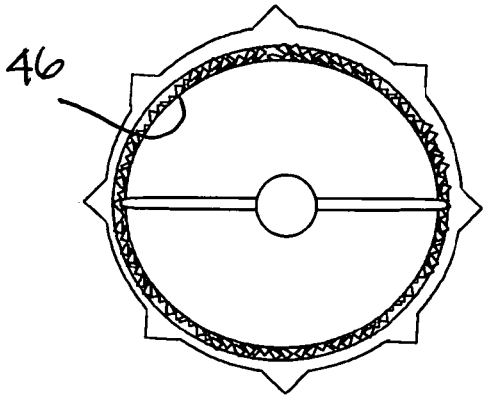
FIG. 6 illustrates a schematic sectional view of another embodiment of another speed reducer assembly embodying the principles of the present invention.
Figure 7:
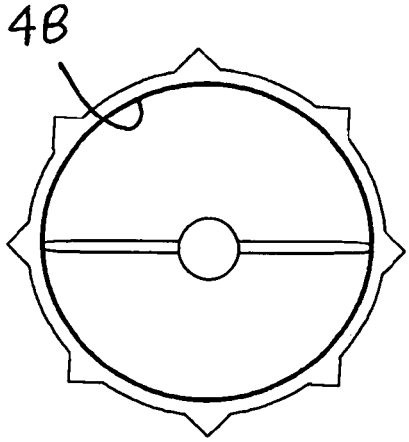
FIG. 7 illustrates a schematic sectional view of another embodiment of another speed reducer assembly embodying the principles of the present invention.

The embodiments illustrated in FIGS. 6 and 7 incorporate non-viscous resistance material in the form of friction material on an interior surface of the speed reducer chamber. In FIG. 6, the friction material comprises a sheet 46 adhered to the interior surface of the speed reducer chamber. The sheet 46 includes friction-enhancing texture, for example, either the hook or loop material used in hook-and-loop fastener fabric. In FIG. 7, the friction material is provided as a sprayed-on coating. Examples of such coatings may include abrasives suspended in adhesive liquid.

Although the present invention has been described with reference to specific embodiments, those of skill in the art will recognize that changes may be made thereto without departing from the scope and spirit of the invention as defined by the appended claims.

What is claimed is:

1. A speed reducer assembly for rolling screen systems, the speed reducer assembly comprising the following:

a speed reducer chamber;

a resistance element mounted for movement within the speed reducer chamber; and a non-viscous resistance material in contact with the resistance element within the speed reducer chamber wherein the non-viscous resistance material comprises a friction material on an interior surface of the speed reducer chamber; and wherein the friction material includes a sprayed-on coating.

2. A speed reducer assembly in accordance with claim 1, wherein the resistance element comprises at least one paddle element secured to a longitudinal shaft.

3. A speed reducer assembly in accordance with claim 2, wherein the resistance element comprises a pair of opposed paddle elements.

4. A speed reducer assembly in accordance with claim 1, wherein the non-viscous resistance material further comprises a flowable solid.

5. A speed reducer assembly in accordance with claim 4, wherein the non-viscous resistance material is selected from a group consisting of thermoplastic chips and generally spheroidal particles.

6. A speed reducer assembly in accordance with claim 1, wherein the non-viscous resistance material further comprises a friction material on an interior surface of the speed reducer chamber.

7. A speed reducer assembly in accordance with claim 6, wherein the friction material further comprises a material selected from a group consisting of a sprayed-on coating and a sheet adhered to the interior surface of the speed reducer chamber.

* * * * *